US010767449B2

(12) United States Patent
Lazo et al.

(10) Patent No.: US 10,767,449 B2
(45) Date of Patent: Sep. 8, 2020

(54) PROTECTIVE SHROUDS FOR SAND CONTROL SCREEN ASSEMBLIES

(71) Applicant: Chevron U.S.A. Inc., San Ramon, CA (US)

(72) Inventors: Antonio Lazo, Houston, TX (US); Namhyo Kim, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 253 days.

(21) Appl. No.: 15/353,029

(22) Filed: Nov. 16, 2016

(65) Prior Publication Data

US 2017/0362919 A1 Dec. 21, 2017

Related U.S. Application Data

(60) Provisional application No. 62/350,443, filed on Jun. 15, 2016, provisional application No. 62/403,922, filed on Oct. 4, 2016.

(51) Int. Cl.
*E21B 43/08* (2006.01)

(52) U.S. Cl.
CPC ..... *E21B 43/08* (2013.01)

(58) Field of Classification Search
CPC ..... E21B 43/08–086; B21C 37/122
USPC ..... 228/137; 29/896.62
See application file for complete search history.

(56) References Cited

U.S. PATENT DOCUMENTS

| | | | | | |
|---|---|---|---|---|---|
| 246,232 | A * | 8/1881 | Spencer | F16L 11/16 | 138/154 |
| 975,334 | A | 8/1910 | Decker et al. | | |
| 1,273,236 | A | 7/1918 | Layne | | |
| 1,878,432 | A | 9/1932 | Whann | | |
| 2,233,233 | A * | 2/1941 | Williams | B21C 37/122 | 138/154 |
| 3,078,818 | A * | 2/1963 | Butler | B21C 37/122 | 228/145 |
| 3,739,134 | A * | 6/1973 | Wade | B21C 37/122 | 219/62 |
| 4,141,481 | A * | 2/1979 | Van Petten | B21C 37/157 | 228/145 |
| 4,251,970 | A * | 2/1981 | Home | B21C 37/157 | 52/674 |
| 4,763,830 | A * | 8/1988 | Davis | B21C 37/122 | 219/62 |
| 5,339,895 | A | 8/1994 | Arterbury et al. | | |
| 5,355,956 | A | 10/1994 | Restarick | | |
| 5,611,399 | A * | 3/1997 | Richard | B01D 29/111 | 166/230 |
| 5,957,205 | A | 9/1999 | Bohme et al. | | |

(Continued)

FOREIGN PATENT DOCUMENTS

| | | |
|---|---|---|
| CN | 105257250 | 1/2016 |
| JP | 2007/126888 | 5/2007 |

(Continued)

*Primary Examiner* — Steven A MacDonald
(74) *Attorney, Agent, or Firm* — King & Spalding LLP

(57) ABSTRACT

A sand control screen assembly having a protective shroud or jacket that provides a controlled offset between the shroud and a filter medium. The sand control screen assembly also includes a base pipe having a drainage layer positioned therearound for preventing the flow of particulate material of a predetermined size therethrough and allowing the flow of production fluids therethrough.

7 Claims, 14 Drawing Sheets

(56) References Cited

U.S. PATENT DOCUMENTS 6,530,431 B1 * 3/2003 Castano-Mears ..... E21B 43/084 166/227
8,251,138 B2 * 8/2012 Bonner ..... E21B 43/084 166/230
8,701,757 B2 * 4/2014 Greci ..... E21B 43/088 166/227
9,441,463 B2 * 9/2016 Cunningham ..... E21B 17/026
2003/0010811 A1 * 1/2003 Chung ..... B21C 37/122 228/173.7
2004/0004110 A1 * 1/2004 Blackburne, Jr. ..... B01D 29/111 228/130
2004/0016539 A1 * 1/2004 Richard ..... E21B 17/1035 166/207
2007/0199973 A1 * 8/2007 Tueshaus ..... B21C 37/122 228/17.7
2008/0289815 A1 11/2008 Moen et al.
2010/0000742 A1 * 1/2010 Bonner ..... E21B 43/08 166/378
2010/0163481 A1 7/2010 McGrenera et al.
2010/0258301 A1 * 10/2010 Bonner ..... E21B 43/084 166/230
2011/0105477 A1 5/2011 Hammer
2011/0180258 A1 7/2011 Scott et al.
2011/0265990 A1 11/2011 Augustine et al.
2012/0073801 A1 3/2012 Greci et al.
2014/0360718 A1 * 12/2014 Ma ..... E21B 43/086 166/231
2015/0144330 A1 5/2015 Noblett et al.
2015/0274352 A1 * 10/2015 Lipp ..... B21C 37/122 206/524.6
2015/0375144 A1 * 12/2015 Greci ..... E21B 43/08 29/896.61
2016/0024895 A1 * 1/2016 Russell ..... E21B 43/084 166/230
2017/0362921 A1 * 12/2017 Kim ..... E21B 43/086

FOREIGN PATENT DOCUMENTS

WO WO 2014/137332 9/2014
WO WO 2017/039840 3/2017

* cited by examiner

500

PROTECTIVE SHROUDS FOR SAND CONTROL SCREEN ASSEMBLIES

CROSS-REFERENCE TO RELATED APPLICATIONS

This application claims priority under 35 U.S.C. § 119 to U.S. Provisional Patent Application Ser. No. 62/350,443, titled "Protective Shrouds For Sand Control Screen Assemblies" and filed on Jun. 15, 2016, and to U.S. Provisional Patent Application Ser. No. 62/403,922, titled "Protective Shrouds For Sand Control Screen Assemblies" and filed on Oct. 4, 2016, the entire contents of which are hereby incorporated herein by reference.

TECHNICAL FIELD

The present application relates generally to structures adapted for filtering particulates from a flowing fluid in a wellbore that traverse a subterranean hydrocarbon bearing formation, and in particular, to protective jackets or shrouds for sand control screen assemblies.

BACKGROUND

Sand exclusion screen assemblies are employed in wellbores during the production of hydrocarbon fluids from subterranean formations. Conventional sand screen assemblies include a perforated base pipe, a drainage layer, a filter medium, and a protective jacket or shroud. Such screen assemblies are designed to filter out particles, such as formation sand or placed gravel/proppant, while facilitating the passage of hydrocarbon fluids into the wellbore. One drawback in the deployment of such screen assemblies is the erosion of the filter medium by particle impingement contained in the fluids that pass the screen assemblies. The presence of particulate in the flow stream, coupled with the current designs and manufacturing methods of the screen assemblies, can cause erosion. For instance, current designs and manufacturing methods minimize the space, or offset, between the sand screen components for a number of reasons, which can increase erosion of the filter medium. For example, the offset between conventional shrouds and the filter medium is not controlled and the shrouds are susceptible to deformation and/or radial movement, which can cause the shroud to interface with the filter medium at various locations away from the welds at the ends of the base pipe. Since conventional shrouds may have perforated holes, these holes cause a flow concentration that localizes and increases the erosion of the filter medium resulting from an inadequate amount of flow dispersion due to the interface between the shroud and the filter medium. When the filter medium becomes eroded, then particles are produced from the well, which is highly undesirable. Production of these particles can cause excessive erosion of production tubulars, downhole equipment and surface equipment, and lead to high maintenance costs and undesirable downtime of wells.

Accordingly, a need has arisen for a sand control screen assembly that is capable of filtering fines out of a production stream from a subterranean hydrocarbon bearing formation and that does not readily suffer from erosion.

SUMMARY

The present application is generally related to protective jackets or shrouds for sand control screen assemblies for filtering particulates from a flowing fluid in a wellbore that traverses a subterranean hydrocarbon bearing formation.

In an example embodiment, a sand control screen assembly includes a filter medium for particle control and/or particle filtration, a protective shroud or jacket disposed about the filter medium, and a radial extension. The radial extension provides substantially uniform radial spacing relative to the jacket's inner surface. Generally, the sand control screen assembly also includes a base pipe and a drainage layer. The drainage layer is positioned about the base pipe, and the filter medium is positioned about the drainage layer. In certain instances where a drainage layer is not utilized, the filter medium is positioned about the base pipe.

In another example embodiment, a sand control screen assembly includes a filter medium for particle control and/or particle filtration, a perforated shroud disposed about the filter medium, and an offset means for ensuring substantially uniform radial spacing relative to the jacket's inner surface. Generally, the sand control screen assembly also includes a base pipe and a drainage layer. The drainage layer is positioned about the base pipe, and the filter medium is positioned about the drainage layer. In certain instances where a drainage layer is not utilized, the filter medium is positioned about the base pipe.

In yet another example embodiment, a method of manufacturing a jacket for a sand control screen assembly includes (a) providing a single sheet of metal, (b) forming at least one protrusion on the metal sheet adjacent to a junction where the metal sheet is assembled to form the jacket, and (c) assembling the metal sheet to form the jacket, wherein upon assembly, the at least one protrusion faces an interior of the jacket. Generally, the sand control screen assembly also includes a filter medium. The jacket is positioned about the filter medium, and the protrusion(s) provide a substantially uniform radial spacing between the filter medium and the jacket.

These and other aspects, objects, features, and embodiments will be apparent from the following description and the appended claims.

DETAILED DESCRIPTION

Figure 1:
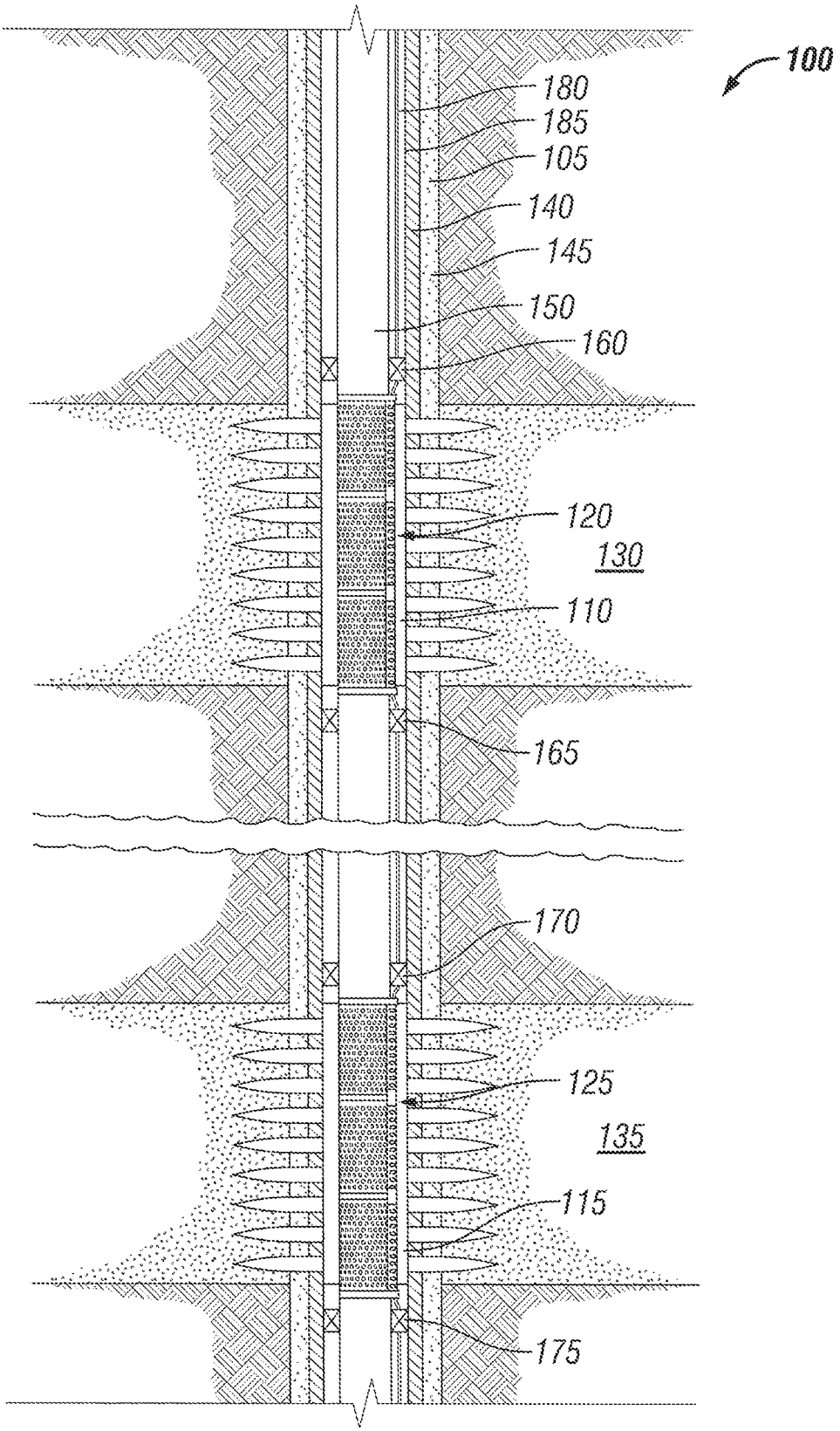
FIG. 1 is a schematic illustration of a wellbore environment including a pair of sand control screen assemblies, according to an embodiment of the present invention.
Figure 2A:
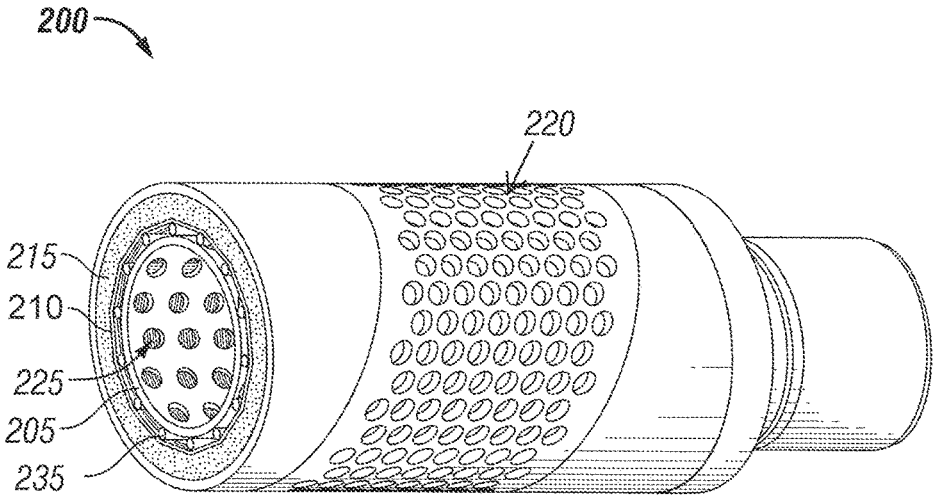
FIG. 2A is a top perspective view of a sand control screen assembly, according to an embodiment of the present invention.
Figure 2B:
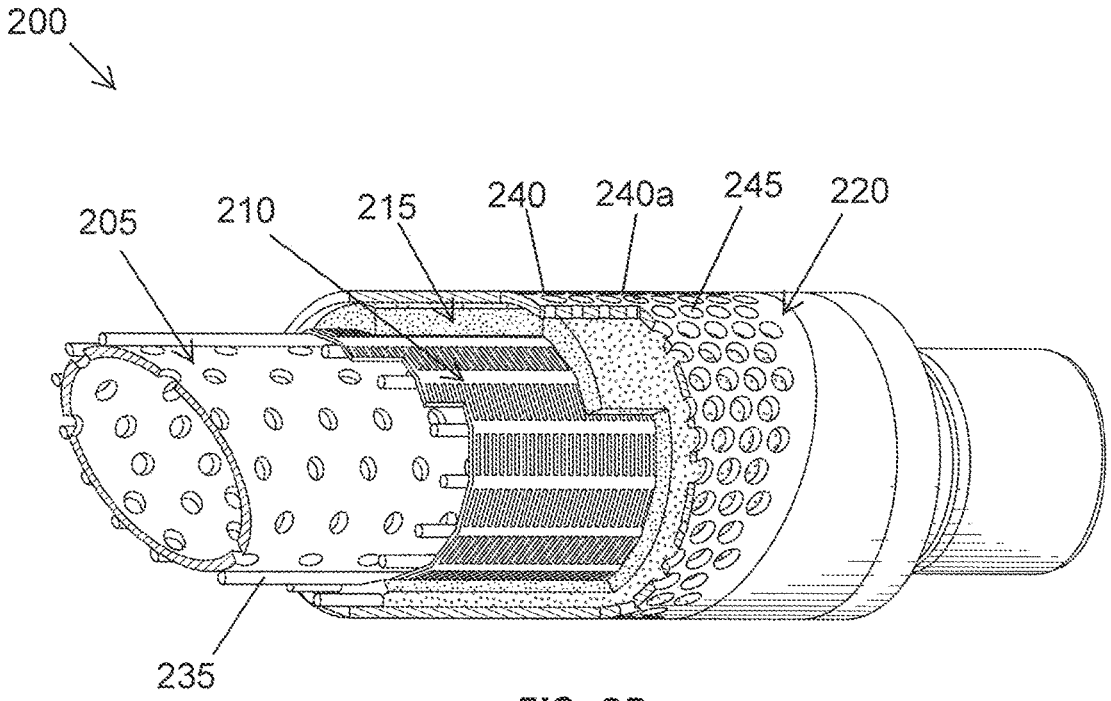
FIG. 2B is a partial cut away view of the sand control screen assembly of FIG. 2A, according to an embodiment of the present invention.
Figure 2D:
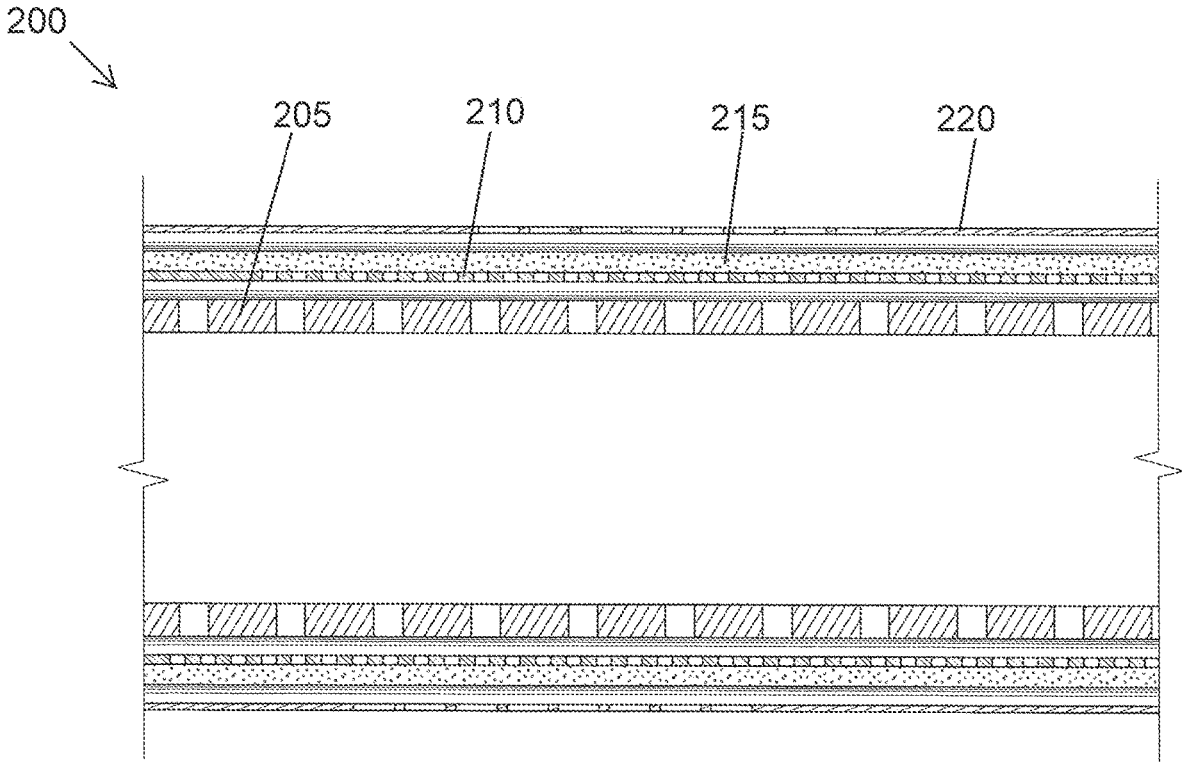
FIG. 2D is a side cross-sectional view of the sand control screen assembly of FIG. 2A, according to an embodiment of the present invention.
Figure 2C:
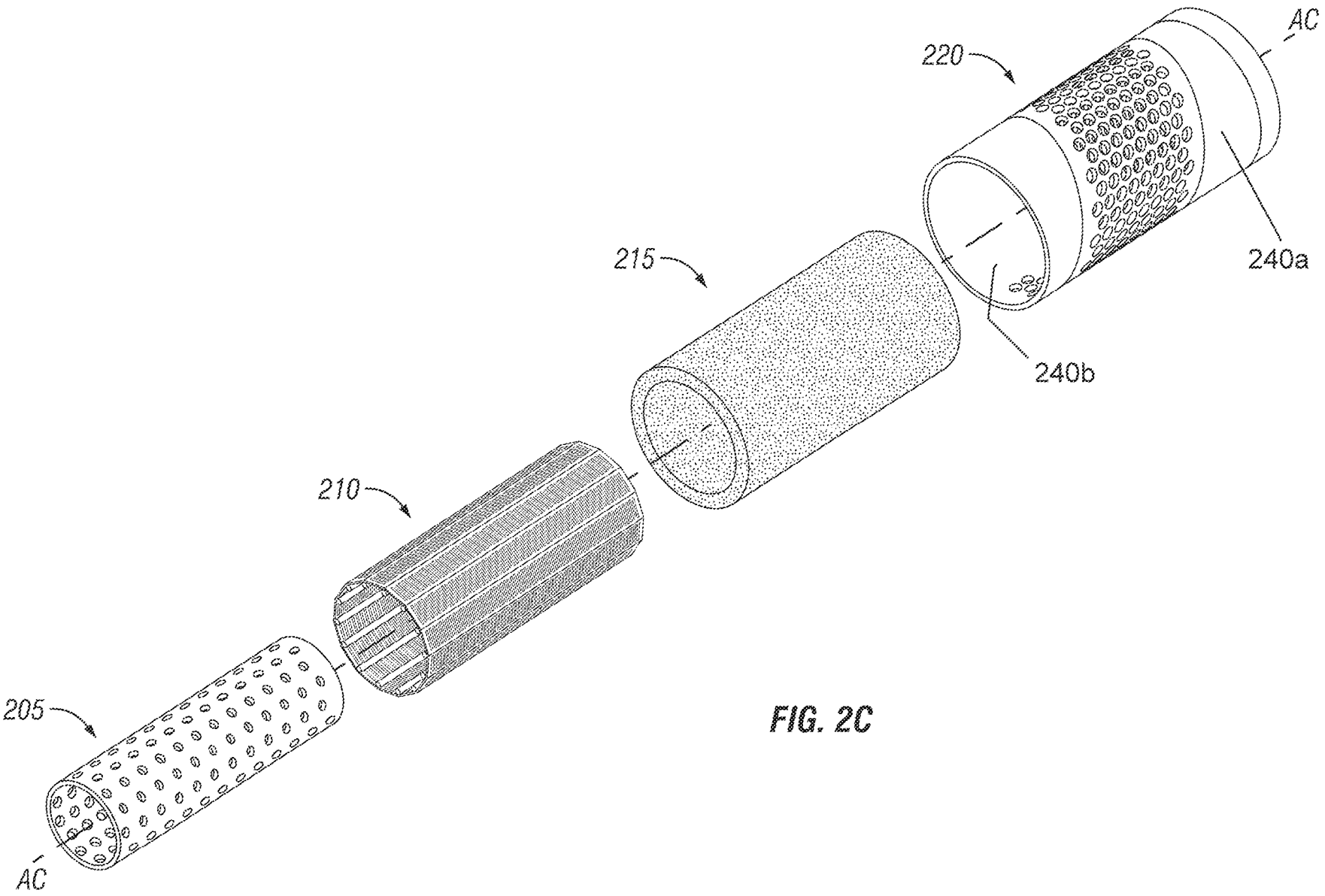
FIG. 2C is an exploded view of the sand control screen assembly of FIG. 2A, according to an embodiment of the present invention.
Figure 3A:
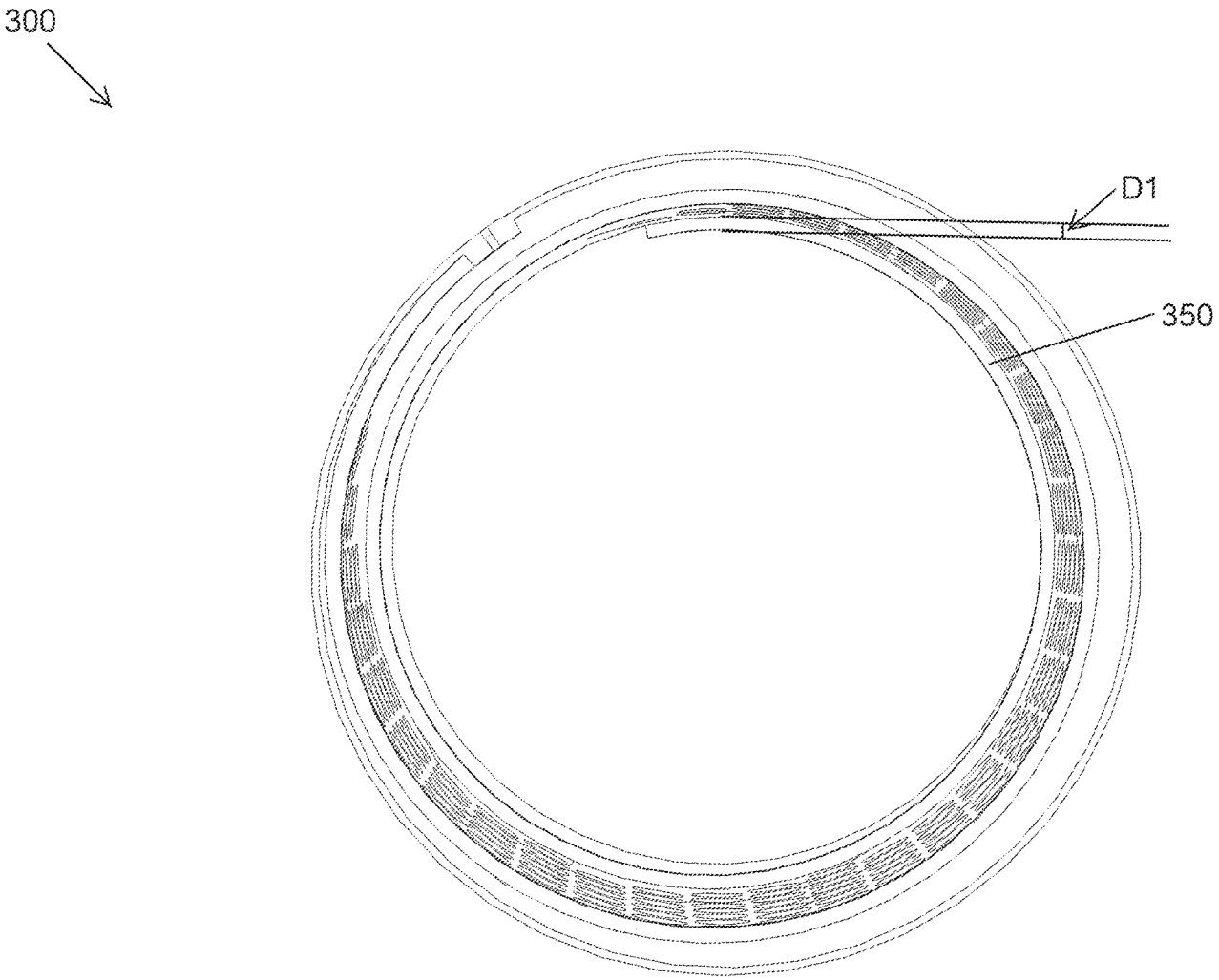
FIG. 3A is a side view of a shroud for a sand control screen assembly, showing the interior of the shroud, according to an embodiment of the present invention.
Figure 3B:
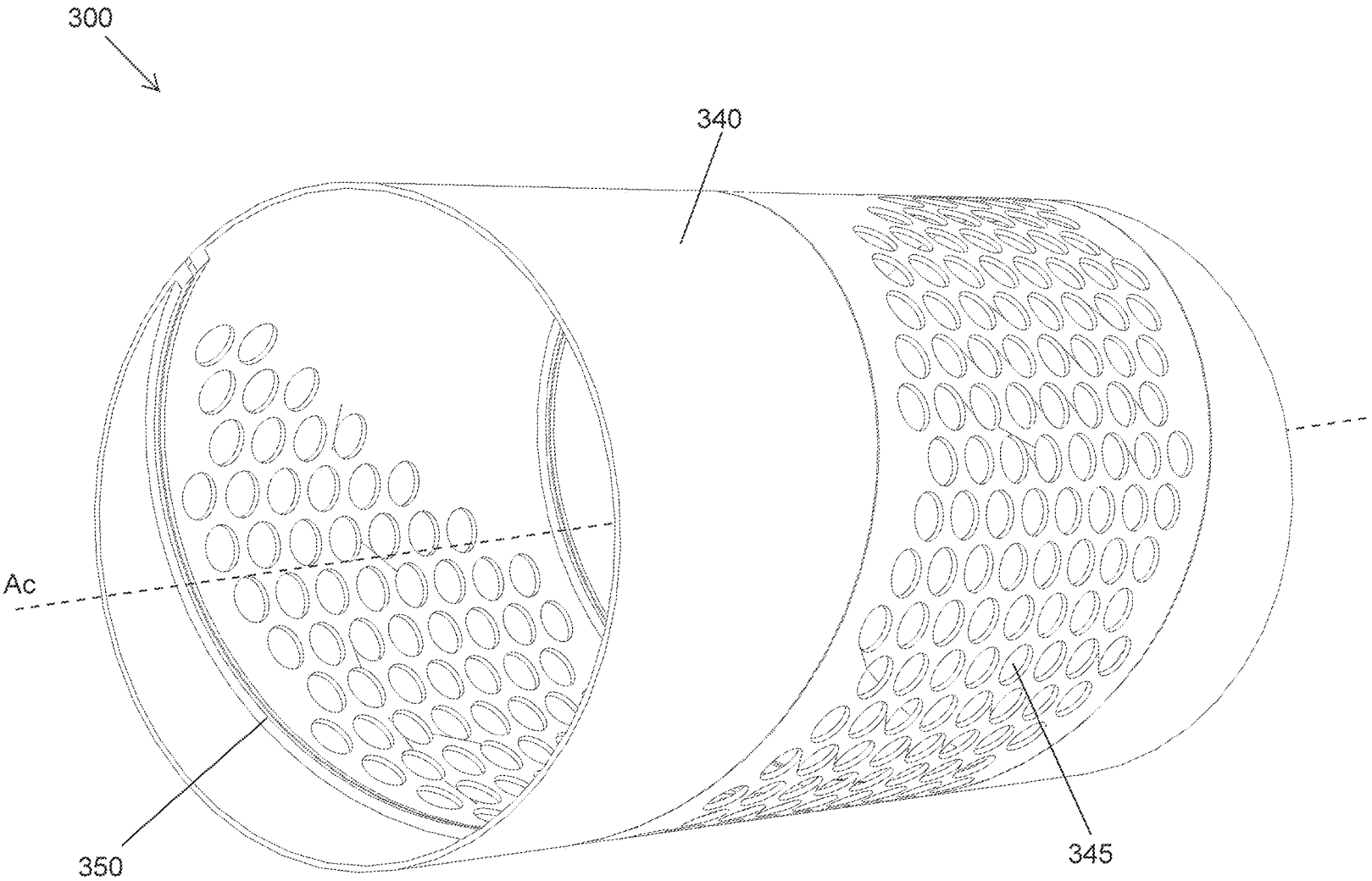
FIG. 3B is a perspective view of the shroud of FIG. 3A, according to an embodiment of the present invention.
Figure 3C:
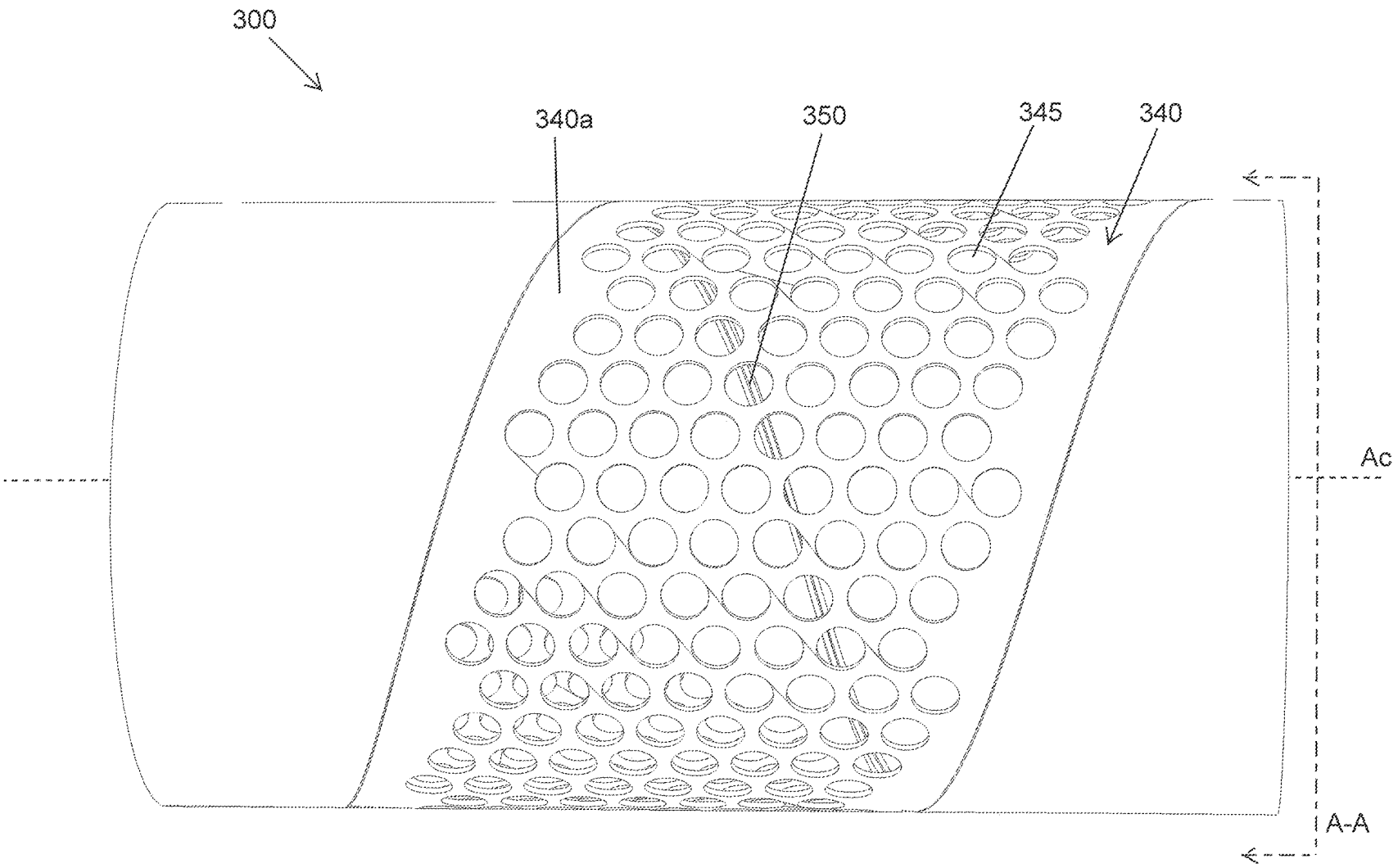
FIG. 3C is a side view of the shroud of FIG. 3A, according to an embodiment of the present invention.
Figure 3D:
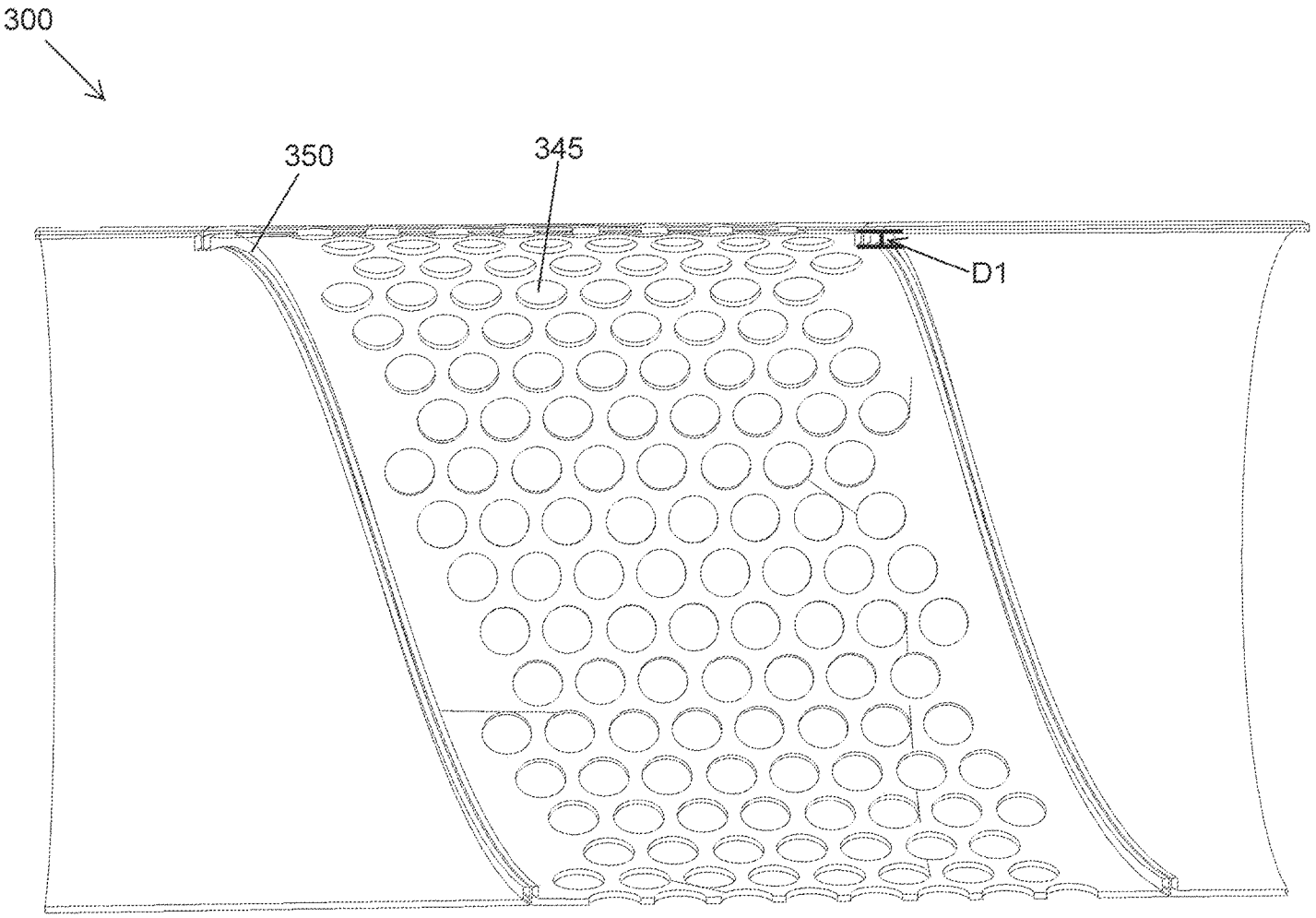
FIG. 3D is a side cross-sectional view of the shroud of FIG. 3A, taken along section A-A, according to an embodiment of the present invention.

The present application provides sand control screen assemblies that are more resistant to erosion than conventional sand control screen assemblies. By limiting erosion loss, it is not required to reduce the rate of oil and gas production, which is common in instances of sand screen erosion.

The invention may be better understood by reading the following description of non-limitative, exemplary embodiments with reference to the attached drawings, wherein like parts of each of the figures are identified by the same reference characters. In the following description of the representative embodiments of the invention, directional terms, such as "above", "below", "top", "bottom", "inner", "outer", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore towards the bottom of well.

Referring to FIG. 1, illustrated is a wellbore system 100 that may employ the principles of the present disclosure, according to one or more embodiments of the disclosure. As depicted, the wellbore system 100 includes a wellbore 105 having production intervals 110, 115, having sand control screen assemblies 120, 125, respectively, positioned therein. The wellbore 105 extends through various formations 130, 135 in the earth strata. A casing 140 is supported within wellbore 105 by cement 145. A production or completion string 150 includes various tools, such as sand control screen assembly 120 that is positioned within production interval 110 between packers 160, 165. In addition, the production or completion string 150 includes a sand control screen assembly 125 that is positioned within production interval 115 between packers 170, 175. The sand control screen assemblies 120, 125 serve the primary functions of filtering particulate matter out of the production fluid stream and may also include flow control capabilities or other additional functionality. One or more control lines 180 may extend from a ground surface within annulus 185 and pass through sand control screen assemblies 120, 125 to provide instructions, carry power, signals and data, and transport operating fluid, such as hydraulic fluid, to sensors, actuators and the like associated with sand control screen assemblies 120, 125 and other tools or components positioned downhole. Sensors (not shown) operably associated with production or completion string 150 may be used to provide valuable information to the operator via control line 180 during the production phase of the well, such as fluid temperature, pressure, velocity, constituent composition and the like, such that the operator can enhance the production operations.

Even though FIG. 1 depicts sand control screen assemblies 120, 125 in a cased hole environment, one skilled in the art will recognize that the sand control screen assemblies of the present invention are equally well suited for use in open hole environments. Also, even though FIG. 1 depicts a vertical completion, one skilled in the art will recognize that the sand control screen assemblies of the present invention are equally well suited for use in well having other directional configurations including horizontal wells, deviated wells, multilateral wells, and the like.

FIGS. 2A-2D illustrate an exemplary embodiment of a sand control screen assembly 200 for use in wellbore 105 (FIG. 1). Along with the other sand control screen assemblies described in the present application, the sand control screen assembly 200 may replace one or more of the screen assemblies 120, 125 described in FIG. 1 and may otherwise be used in the exemplary wellbore system 100 depicted therein.

The screen assembly 200 generally includes a perforated base pipe 205, a drainage layer 210, a filter medium 215, and a protective jacket or shroud 220. Generally, during hydrocarbon production, fluid from the subterranean formation flows in a direction from the formation, through the shroud 220, and towards a central axis Ac of the base pipe 205. The base pipe 205 provides structural support to the assembly 200, and also provides flow communication via openings 225 with the production or completion string 150 (FIG. 1) in the wellbore 105. The drainage layer 210 occasionally is a slotted screen and includes a plurality of ribs 235 that are substantially symmetrically disposed or positioned about the central axis Ac of the base pipe 205. In certain embodiments, the slotted screen is made up of wrapped wires. The drainage layer 210 is placed around the surface of the base pipe 205 and typically distributes inflow to the base pipe 205. In certain embodiments, the drainage layer 210, composed of the slotted screen and the plurality of ribs 235, can be replaced by other porous structures such as metal meshes. The filter medium 215 that surrounds the drainage layer 210 is utilized for particle control and/or particle filtration of a predetermined size. The filter medium 215 is generally woven, wire-wrapped, or a slotted liner. The shroud 220 surrounds the filter medium 215 and provides protection to the assembly 200 during installation. In certain exemplary embodiments, the shroud 220 is a perforated jacket. In certain other embodiments, the shroud 220 may be a slotted screen jacket or a stamped jacket. The shroud 220 is a generally cylindrical-shaped tube 240 having one or more openings 245 that extend from an outer wall 240*a* of the tube 240 to an inner wall 240*b* of the tube 240. Fluid from the subterranean formation generally flows in a direction from the outer wall 240*a* towards the inner wall 240*b* through openings 245. An offset means is provided between the shroud 220 and the filter medium 215, as described further with the exemplary embodiments below.

FIGS. 3A-3D illustrate an exemplary embodiment of a shroud 300 for a sand control screen assembly for use in a wellbore. Along with the other shrouds described in the present application, the shroud 300 may replace the shroud 220 of the sand control screen assembly 200 described in FIGS. 2A-D and may otherwise be used in the exemplary wellbore system 100 (FIG. 1) depicted therein.

The shroud 300 is a generally cylindrical-shaped tube 340 having one or more openings 345 that extend from an outer wall 340*a* of the tube 340 to an inner wall 340*b* of the tube 340, whereby fluid can pass through the openings 345. In certain exemplary embodiments, the shroud 300 includes an offset D1 provided by a radial extension 350. The radial extension 350 protrudes radially inwards towards a central axis Ac, and provides offset D1 between the shroud 300 and a filter medium (not shown). The offset D1 can be in the range of from about 0.05 to about 1.0 inch. In certain embodiments, the shroud 300 may be manufactured from a single sheet of metal with a bend of about 90 degrees at the edges to allow for a predetermined length protruding radially inward when the tube 340 is assembled. Generally, the bends at the edges can be in a range of from about 60 to about 120 degrees inwards to form the offset D1. Once the tube 340 is constructed, the controlled offset D1 allows for dispersion of fluid flow and therefore a decay of velocities approaching the filter medium. The lower approach velocity results in a lower erosion rate over conventional shrouds utilized. In addition, in certain embodiments, the offset D1 may also provide some structural support to the shroud 300.

Figure 4A:
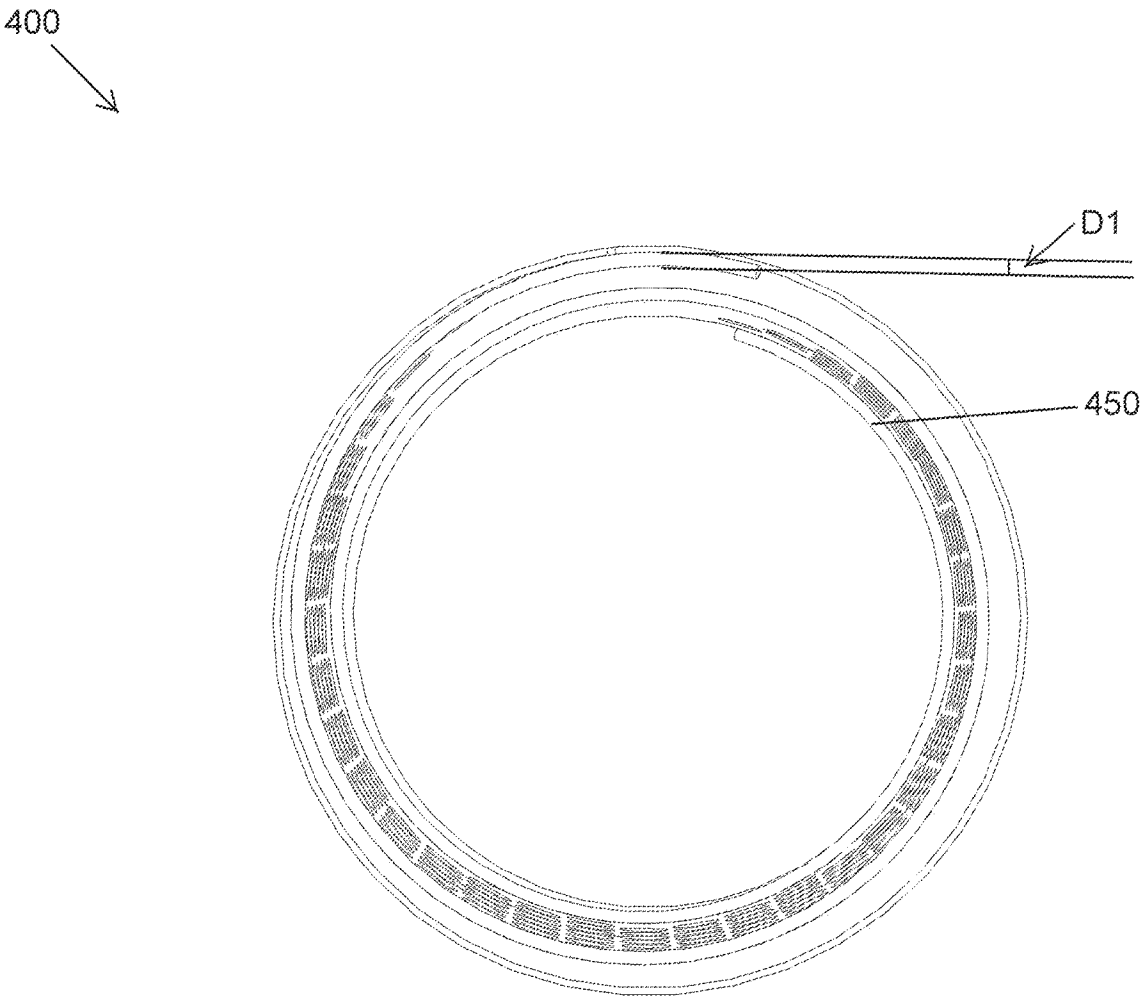
FIG. 4A is a side view of another shroud for a sand control screen assembly, showing the interior of the shroud, according to an embodiment of the present invention.
Figure 4B:
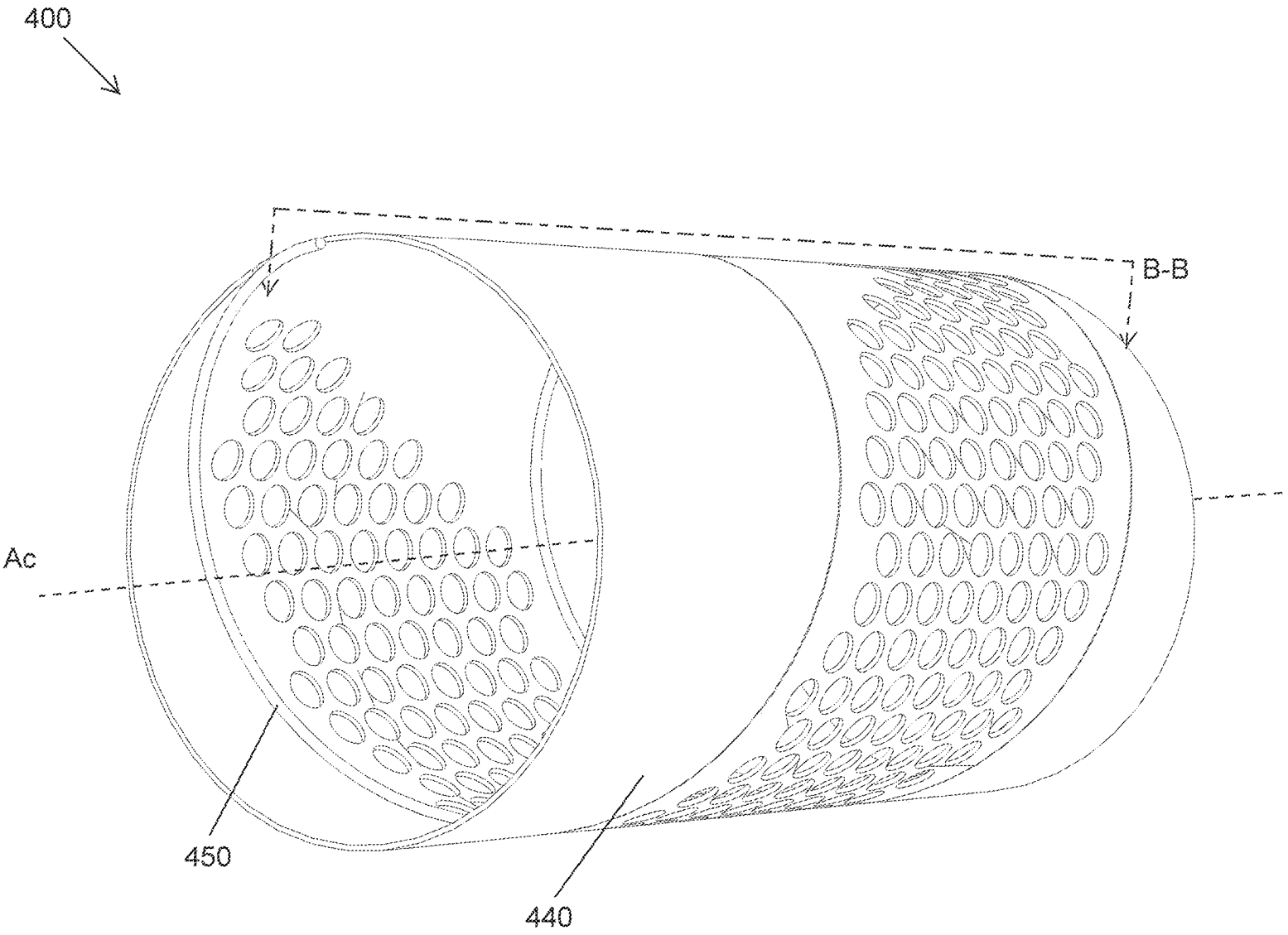
FIG. 4B is a perspective view of the shroud of FIG. 4A, according to an embodiment of the present invention.
Figure 4C:
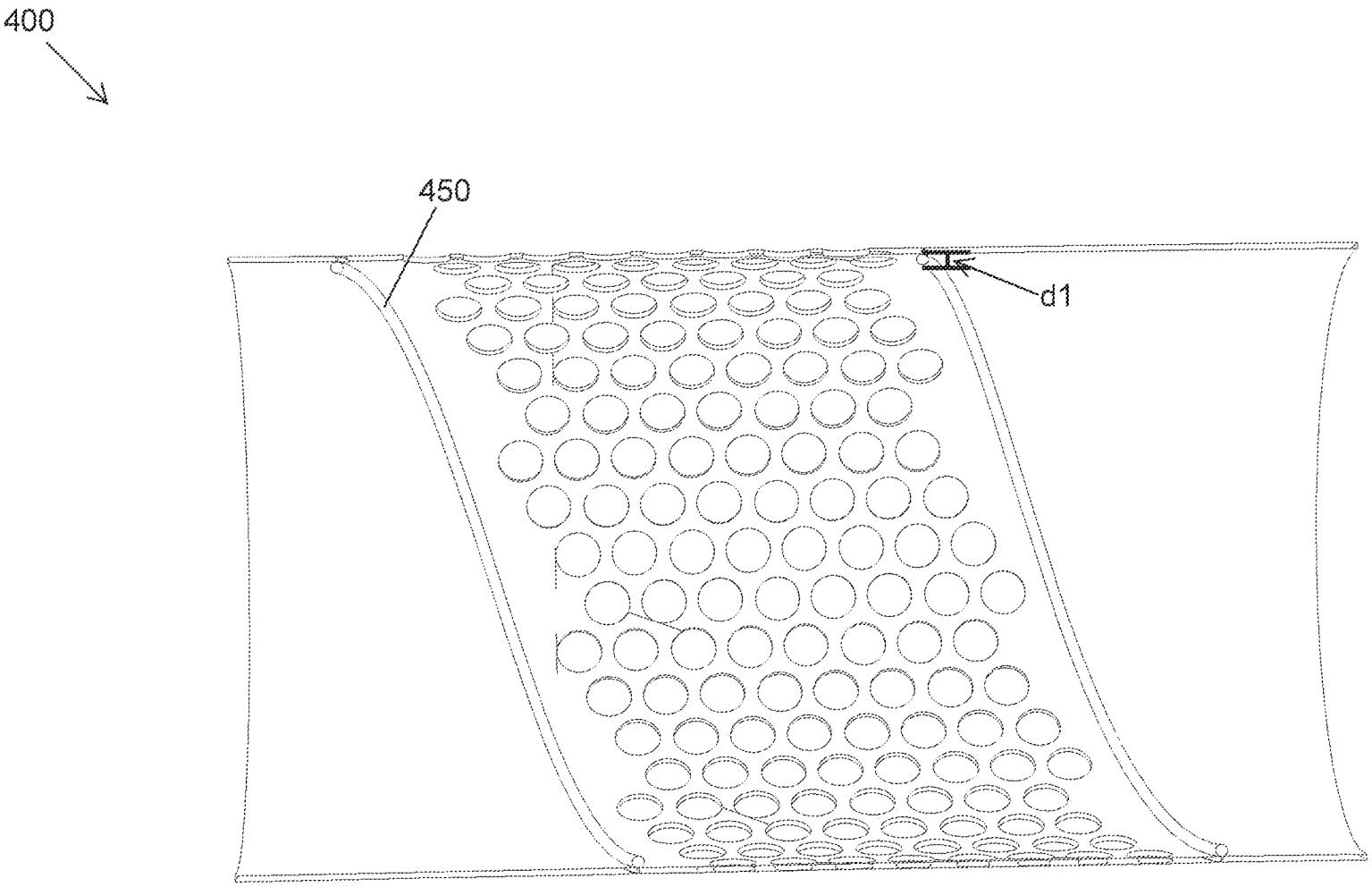
FIG. 4C is a side cross-sectional view of the shroud of FIG. 4A, taken along section B-B, according to an embodiment of the present invention.

FIGS. 4A-4C illustrate an exemplary embodiment of a shroud 400 for a sand control screen assembly for use in a wellbore. Along with the other shrouds described in the present application, the shroud 400 may replace the shroud 220 of the sand control screen assembly 200 described in FIGS. 2A-D and may otherwise be used in the exemplary wellbore system 100 (FIG. 1) depicted therein. The shroud 400 is the same as that described above with regard to shroud 300, except as specifically stated below. For the sake of brevity, the similarities will not be repeated hereinbelow.

Referring now to FIG. 4A-4C, the shroud 400 includes an offset dl provided by a wire 450 that is coupled to a metal sheet that is welded to form tube 440 of the shroud 400. The wire 450 protrudes radially inwards towards central axis Ac, and has a dimension that provides an offset dl between the shroud 400 and a filter medium (not shown). In certain exemplary embodiments, the wire has a circular cross section and the diameter/offset dl can be in the range of from about 0.05 to about 1.0 inch. The wire 450 may be coupled to the tube 440 in any suitable manner known to one having ordinary skill in the art, such as helical or longitudinal welding.

Figure 5A:
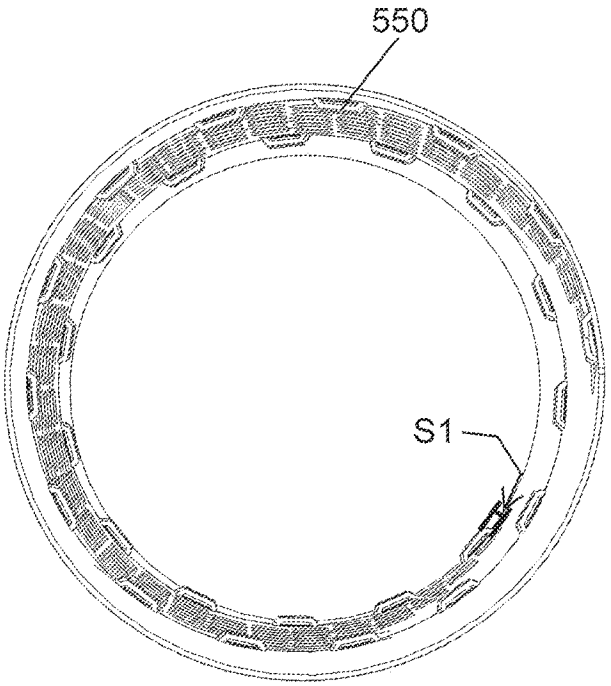
FIG. 5A is a side view of yet another shroud for a sand control screen assembly, showing the interior of the shroud, according to an embodiment of the present invention.
Figure 5B:
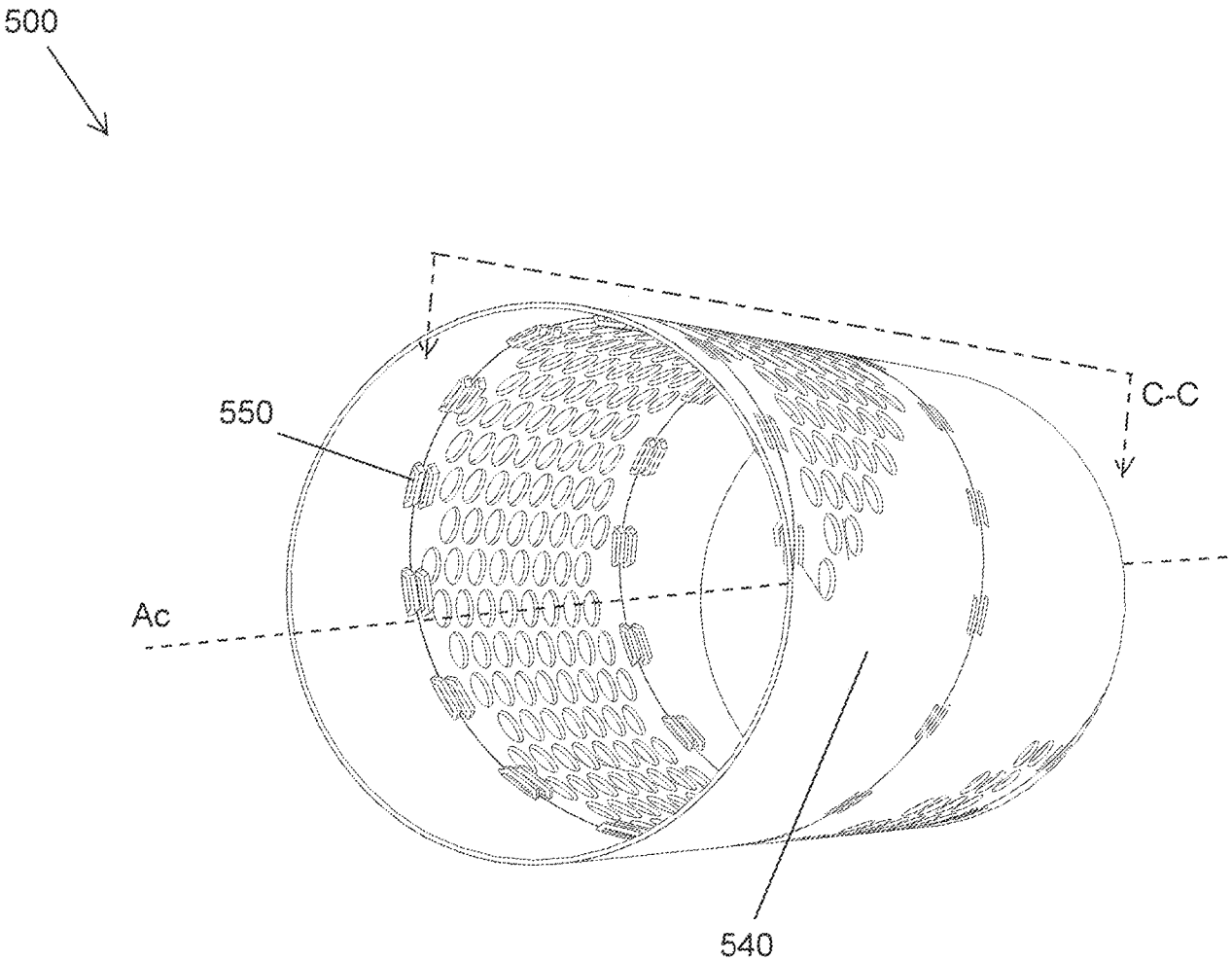
FIG. 5B is a perspective view of the shroud of FIG. 5A, according to an embodiment of the present invention.
Figure 5C:
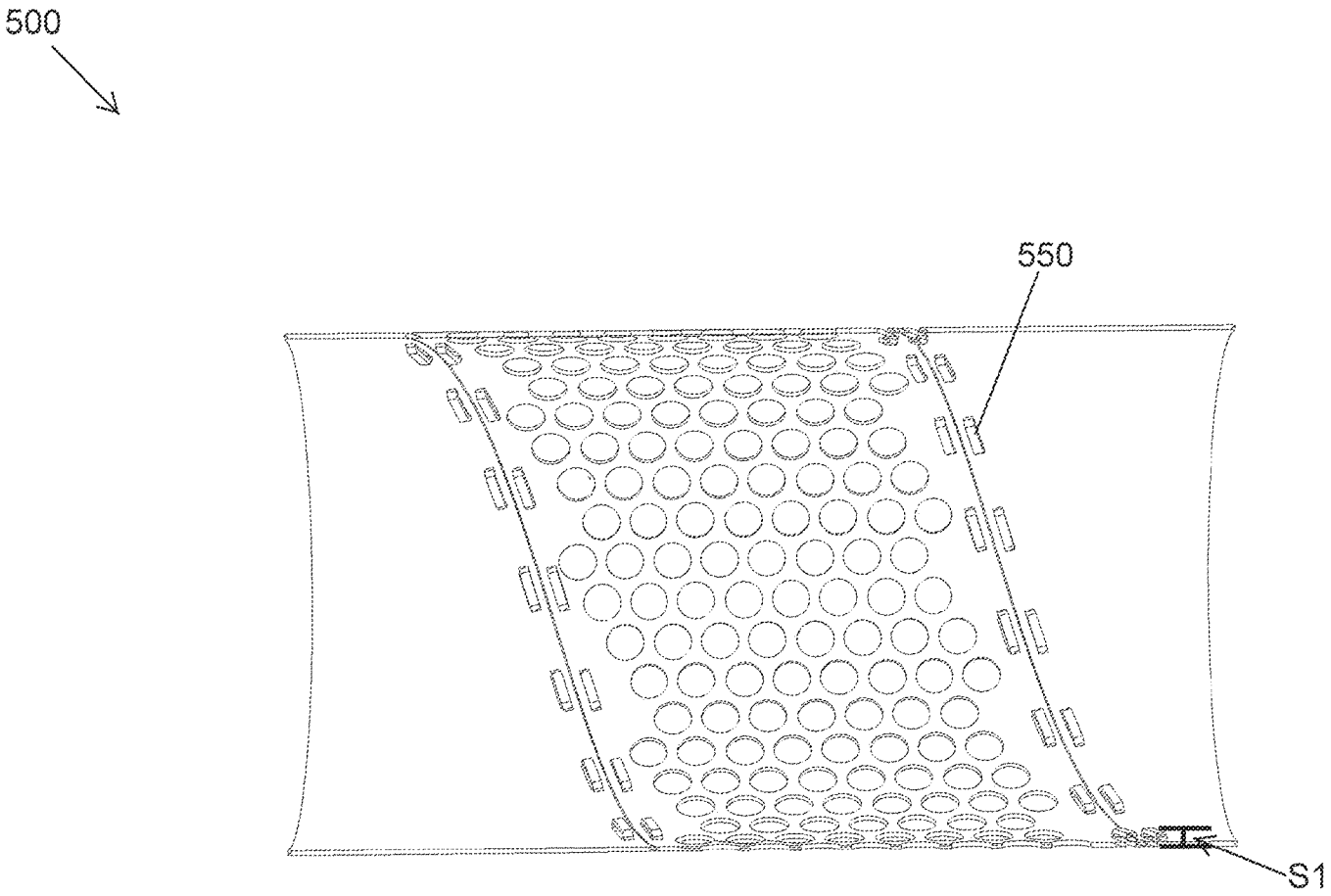
FIG. 5C is a side cross-sectional view of the shroud of FIG. 5A, taken along section C-C, according to an embodiment of the present invention.

FIGS. 5A-5C illustrate an exemplary embodiment of a shroud 500 for a sand control screen assembly for use in a wellbore. Along with the other shrouds described in the present application, the shroud 500 may replace the shroud 220 of the sand control screen assembly 200 described in FIGS. 2A-D and may otherwise be used in the exemplary wellbore system 100 (FIG. 1) depicted therein. The shroud 500 is the same as that described above with regard to shroud 300, except as specifically stated below. For the sake of brevity, the similarities will not be repeated hereinbelow.

Referring now to FIG. 5A-5C, the shroud 500 includes an offset 51 provided by dimples or protrusions 550 that are formed adjacent to or near the junctions where a metal sheet is welded to form tube 540 of the shroud 500. In certain alternative embodiments, the protrusions 550 are formed at a position away from the junctions. The protrusions 550 protrude radially inwards towards central axis Ac, and provide an offset 51 between the shroud 500 and a filter medium (not shown). In certain exemplary embodiments, the offset Si can be in the range of from about 0.05 to about 1.0 inch. The protrusions 550 may be formed in the metal sheet forming the tube 540 in any suitable manner known to one having ordinary skill in the art, such as stamping. In addition, while the present figures illustrate rectangular protrusions 550, one having ordinary skill in the art will recognize that in alternative embodiments, the protrusions can have any profile shape configuration, such as triangular, circular, elliptical, oval, square, quatrefoil, curvilinear triangular, trapezoidal, pentagon, hexagon, other polygons, asymmetrical, and the like. In certain exemplary embodiments, the protrusions 550 line up in pairs when the tube 540 is assembled, as shown in FIG. 5B. In certain other embodiments, the protrusions 550 may be offset from one another when the tube 540 is assembled.

In certain exemplary embodiments, methods of the present invention include methods of manufacturing a jacket for a sand control screen assembly. A single sheet of metal includes at least one protrusion adjacent to a junction where the metal sheet is assembled to form the jacket. The jacket is then assembled from the metal sheet such that the at least one protrusion extends towards the interior of the jacket. In certain embodiments, the protrusion may be a wire assembly, such as wire 450 (FIGS. 4A-4C). In certain other embodiments, the protrusion is formed by a bend at an edge of the metal sheet, as described with respect to FIGS. 3A-3D. In yet other embodiments, the protrusions are dimples, such as protrusions 550 (FIGS. 5A-5C).

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A sand control screen assembly, comprising:

a filter medium for particle control and/or particle filtration, wherein the filter medium has a continuous cylindrical shape;

a jacket disposed about the filter medium, wherein the jacket comprises a sheet of metal having a left side with a left edge and a right side with a right edge, wherein the sheet of metal is wrapped helically around itself to form a tube, wherein the left edge and the right edge abut against each other without overlapping to form a seam when the sheet of metal forms the tube; and a radial extension welded to an inner surface of the jacket at the seam along a length of the seam, wherein the radial extension forms a continuous spiral shape and provides substantially uniform radial spacing between the inner surface of the jacket and an outer surface of the filter medium, wherein the radial extension abuts against the outer surface of the filter medium.

2. The sand control screen assembly of claim 1, wherein the radial extension comprises a wire assembly.

3. The sand control screen assembly of claim 2, wherein the wire assembly is welded to the inner surface of the jacket along the seam, wherein the wire assembly is disposed entirely along the inner surface of the jacket.

4. The sand control screen assembly of claim 1, wherein the radial spacing is in a range of from about 0.05 to about 1.0 inch.

5. The sand control screen assembly of claim 1, further comprising a base pipe, wherein the filter medium is disposed about the base pipe.

6. The sand control screen assembly of claim 1, further comprising a base pipe and a drainage layer, wherein the filter medium is disposed about the drainage layer, and wherein the drainage layer is disposed about the base pipe.

7. The sand control screen assembly of claim 1, wherein the left edge and the right edge of the sheet of metal are welded to each other to form the seam when the sheet of metal forms the jacket.

* * * * *